United States Patent [19]

Douglas et al.

[11] 4,244,141

[45] Jan. 13, 1981

[54] WALKING TURNING DOLL MECHANISM

[75] Inventors: Raymond J. Douglas, Carson; Norman E. Sindlinger, Los Angeles, both of Calif.

[73] Assignee: Mattel, Inc., Hawthorne, Calif.

[21] Appl. No.: 770,089

[22] Filed: Feb. 18, 1977

[51] Int. Cl.[3] ..... A63H 11/14

[52] U.S. Cl. ..... 46/150; 46/266

[58] Field of Search ..... 46/150, 265, 266, 264, 46/136

[56] References Cited

U.S. PATENT DOCUMENTS

| | | | |
|---|---|---|---|
| 3,010,729 | 11/1961 | Tomosy | 46/150 X |
| 3,267,608 | 8/1966 | Ryan | 46/150 X |
| 3,421,258 | 1/1969 | Gardel et al. | 46/266 |
| 3,596,398 | 8/1971 | Gardel et al. | 46/150 |
| 3,599,364 | 8/1971 | Garcia | 46/136 |

FOREIGN PATENT DOCUMENTS

| | | | |
|---|---|---|---|
| 494609 | 7/1950 | Belgium | 46/120 |
| 719817 | 12/1954 | United Kingdom | 46/150 |

*Primary Examiner*—F. Barry Shay

*Attorney, Agent, or Firm*—John G. Mesaros; Max E. Shirk; Ronald M. Goldman

[57] ABSTRACT

A motor operated walking doll which upon energization of the motor walks in a straight line for a given distance, then proceeds along a curve to turn around, then commences on a straight line to its approximate starting point whereupon the doll raises its arms, the arm raising action de-energizing the switch to the motor.

10 Claims, 7 Drawing Figures

2
20
32
44
42
46
52
38
40
54
18
48
58
56
50
16
98
100
70
68
64
60
62
30
28
102
66
106
124a
92
33
34
22
220
124
218
222
10
90
216
24
26
210
214
156
190
200
162
112
212
172
148
164
12
206a
160
150
152
144
154
14
206
192
198
170
166
168
2

202
204
36
200
216
214
210
198
220
212
218
124
124a
90
222
134
132
122
120
130
128
108
104
116
74
106
38
44
60
64
56
114
70
40
76
118
68
142
140
102
190
146
52
66
148
144
72
70
94
178
50
110
70
58
54
62
112
192
156
194
34
150
196
168
160
46
48

WALKING TURNING DOLL MECHANISM

CROSS-REFERENCE TO RELATED APPLICATION

This patent application is related to United States patent application Ser. No. 770,090 filed Feb. 18, 1977, and assigned to the assignee of the instant invention, said application being entitled "Walking Turnaround Doll" by Gabriel (NMI) Marason, Jr.

BACKGROUND OF THE INVENTION

The background of the invention will be discussed in two parts:

FIELD OF THE INVENTION

This invention relates to walking dolls and more particularly to a motor operated walking doll.

DESCRIPTION OF THE PRIOR ART

Free-standing walking figures or toys are a constant source of amusement to children.

Such prior art walking dolls have generally been of the type that walk along a generally straight line which usually requires that the child follow the doll. Such dolls are shown in U.S. Pat. No. 3,267,608 and 3,596,398. The dolls which are the subject of both of these patents are intended for walking in a straight line.

Accordingly, it is an object of this invention to provide a new and improved walking doll.

It is another object of this invention to provide a walking doll which has means for enabling the doll to return to its approximate starting point.

It is another object of this invention to provide a new and improved walking mechanism.

SUMMARY OF THE INVENTION

The foregoing and other objects of the invention are accomplished by providing a doll having a substantially upright torso with a pair of depending substantially rigid legs having ground-engaging feet at the lower ends. Each of the legs is pivotally secured to the torso for side-to-side movement with respect thereto. Each leg is supported by a front bearing member and a rear bearing member, the front bearing member being generally a shaft in a circular aperture with a limited amount of play therebetween. The rear bearing member is a slotted member having a shaft extending therein, the slot generally being aligned in a vertical direction to allow straight line forward movement of the doll during pivoting of the legs from side-to-side to cause the doll to move in a straight line. Cam means are operable by the drive motor, the cam means having a cam follower arm adapted to reorient the slots approximately 60°, thus shifing the rear supports of the shafts defining the axes about which the legs pivot and redefining the pivot axes sufficiently to cause the legs of the doll to swing at an angle to the straight line direction resulting in the doll walking along a curved line until the doll has generally turned around whereupon the cam follower arm of the cam means realigns the slots to a generally vertical position to enable the doll to walk along a straight line. The head and arms of the doll are pivotally interconnected and spring-biased with the arms normally directed generally upwards. Switch means are provided and operable by the lowering of the arms, the drive means including a projection adapted for contacting the switch means after a complete cycle of operation to release the arms and de-energize the drive means.

Other objects, features and advantages of the invention will become apparent upon a reading of the specification when taken in conjunction with the drawings in which like reference numerals refer to like elements in the several views.

DESCRIPTION OF THE PREFERRED EMBODIMENT

Figure 1:
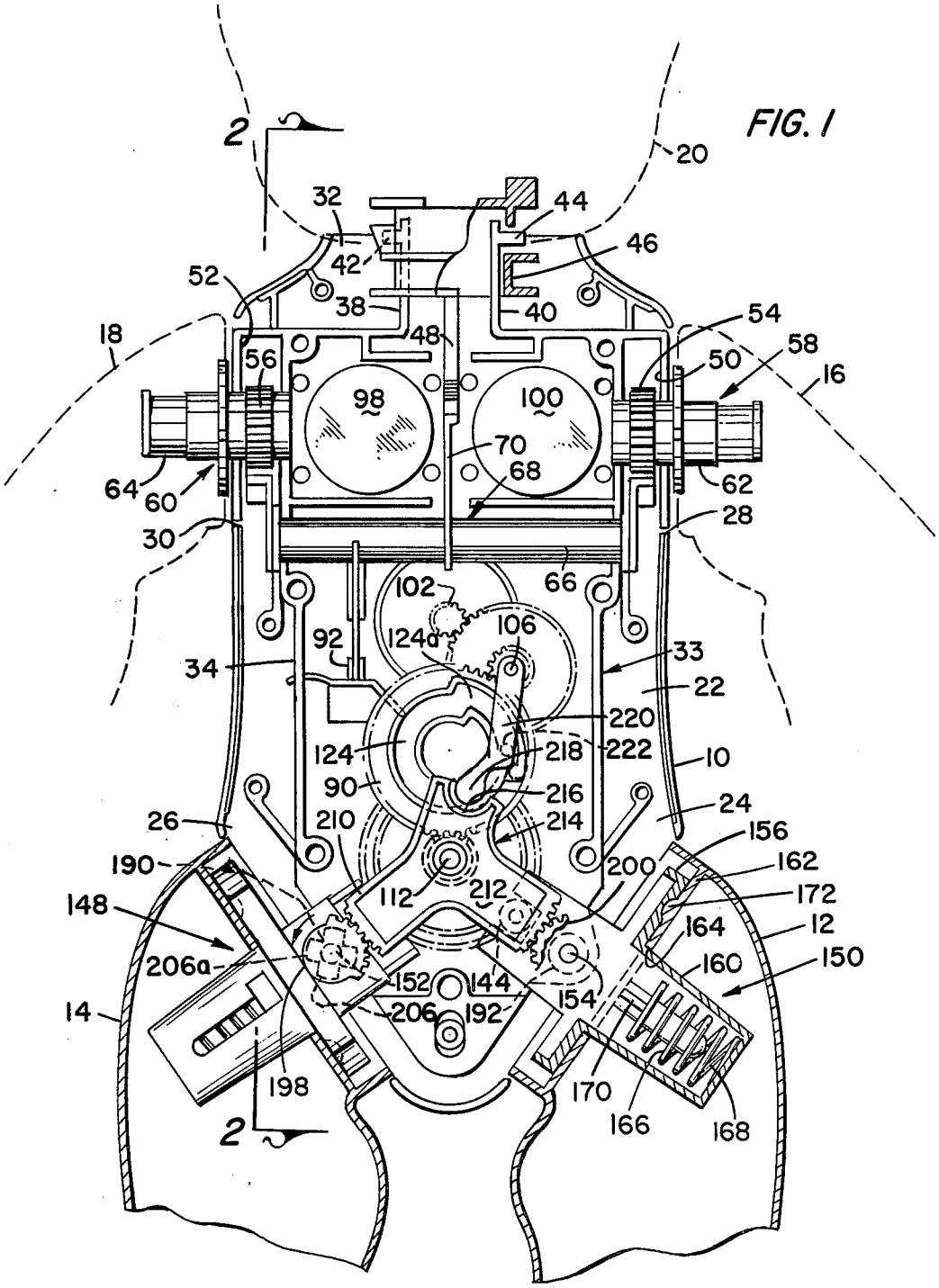
FIG. 1 is a plan view from the rear of the doll with the rear half of the torso removed (partially in cross section and partially broken away)
Figure 2:
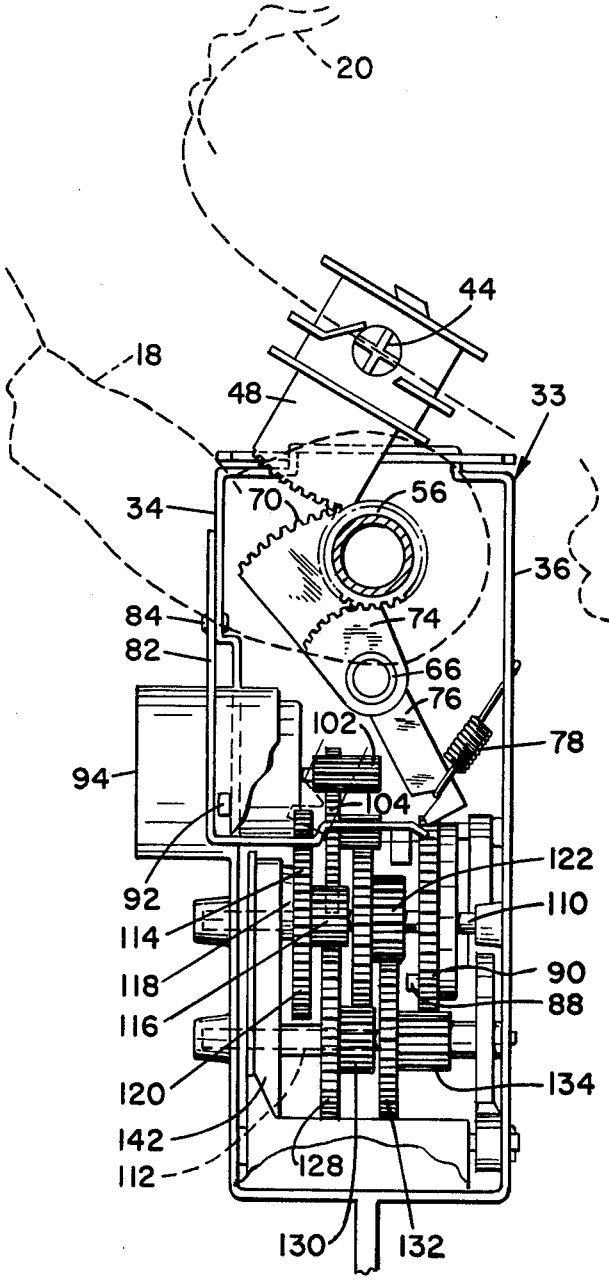
FIG. 2 is a cross-sectional view of the mechanical components within the torso taken generally along line 2—2 of FIG. 1.
Figure 7:
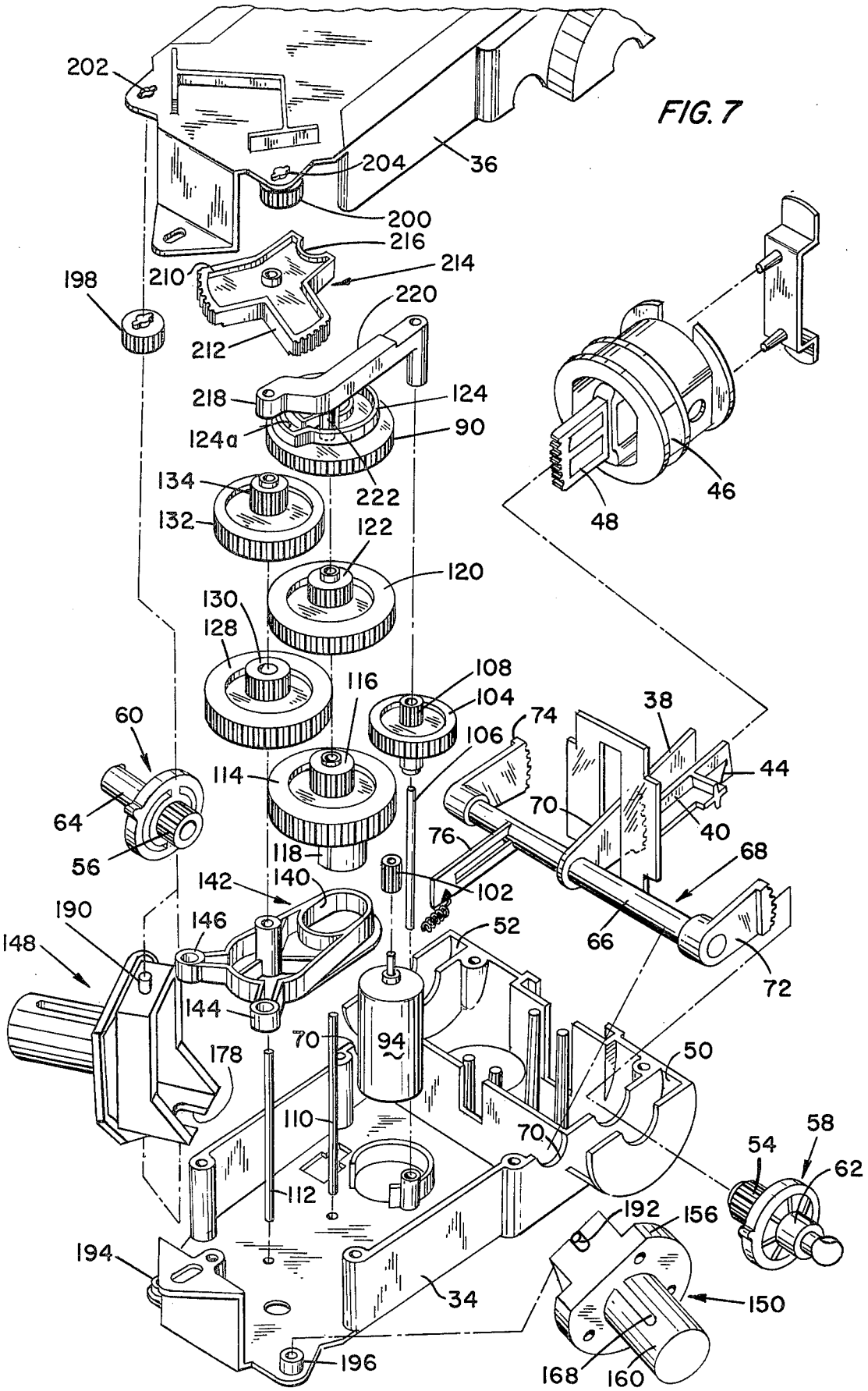
FIG. 7 is an exploded perspective view of the walking mechanism of the doll of FIG. 1.

Referring now to the drawings and particularly to FIGS. 1, 2 and 7, there is shown a doll having a substantially upright torso 10, first and second legs 12 and 14, respectively, a pair of arms 16 and 18 and a head 20.

The torso 10 is generally comprised of a front and a rear mating sections of generally rigid plastic material fitting together to form a hollow interior 22, the torso 10 having suitable leg openings 24 and 26, arm openings 28 and 30 and a neck opening 32.

Positioned within the torso 10 in fixed relationship therein is a two-part component housing having a front half 34 and a rear half 36, the two halfs being suitably secured together to form a hollow interior for receiving components therein (see FIG. 7). Although a component housing is shown within the torso, it is to be understood that the component housing is not required, but is provided as a convenience to facilitate assembly of the doll. In the described embodiment the legs 12 and 14, the arms 16 and 18, and the head 20 are assembled as will hereinafter be described to the component housing, such members are secured with relation to the torso due to the fixed relation between the component housing within the torso 10.

Briefly, the component housing generally designated 33 is suitably configured to receive the following functional subassemblies. The upper portion of component housing 33 is configured to receive the arm and head pivoting mechanism as well as suitable batteries (not shown). The mid-portion of component housing 33 contains the drive means and cycling sub-assembly while the lower portion of component housing 33 generally contains the leg pivoting mechanism.

The upper portion of component housing 33 is provided with a pair of upwardly extending integral bar members 38 and 40 extending into the neck opening 32 of torso 10, the bar members 38 and 40 having outwardly extending aligned stub shafts 42 and 44 respectively, to provide a pivot point for a generally cylindrical head-supporting member 46 to which head 20 is suitably secured to the upper end thereof. Downwardly depending from and integral with head-supporting member 46 is a sector gear 48 positioned generally along the longitudinal center line passing vertically through the torso 10.

Extending transversely to the longitudinal center line of the torso 10 in the upper portion of component housing 33, the component housing 33 is configured to provide a pair of aligned generally cylindrical recesses 50 and 52, each being adapted to rotatably receive a gear portion 54 and 56, respectively, of arm coupling members 58 and 60, respectively. Each of the arm coupling members 58 and 60 has a stub shaft portion 62 and 64, respectively, extending through arm openings 28 and 30, respectively, to which arms 16 and 18, respectively, are secured. Parallel to a line through shaft 62 and 64, a shaft 66 of a head and arm interconnecting and pivoting member generally designated 68, is pivotally secured within mating recesses 70 in opposing sidewalls of the component housing 33.

Figure 3:
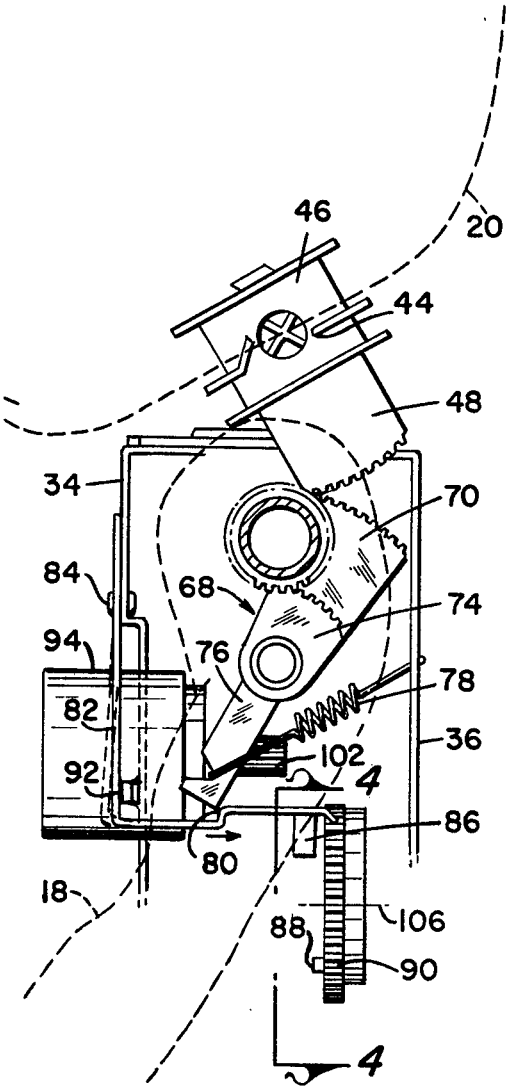
FIG. 3 is a side view of a portion of FIG. 2 showing the arm and head pivoting mechanism in conjunction with the motor switch means.

As better illustrated in FIGS. 2, 3 and 7 the head and arm pivoting member 68 is provided with a first sector gear portion 70 extending generally perpendicular to the shaft 66 thereof along the longitudinal center line of the torso 10, the sector gear 70 engaging the sector gear 48 of the head-supporting member 46. Upwardly extending from either end of shaft 66 are second and third gear sector portions 72 and 74, respectively, engaging gears 54 and 56, respectively, of the arm coupling members 58 and 60, respectively. By this mechanism upon pivoting of the member 68 about shaft 66 the arms 16 and 18 and the head 20 are pivotally interconnected for simultaneous movement. Although both the head and arms are shown as being pivotable simultaneously it is to be understood that the head need not be pivoted and further the engaging sector gears utilized to pivot the head can be replaced with any suitable linkage or ball and socket arrangement if so desired.

Secured to shaft 66 and downwardly depending therefrom in a direction generally opposite to the direction of the three aforementioned sector gears, there is a switch actuating arm 76 to which is suitably secured one end of a spring 78, the other end of spring 78 being secured to an adjacent wall of the rear half 36 of component housing 33 to suitably bias the switch arm 76 in the position shown in FIG. 2, this position corresponding to the arm 18, shown in dotted lines, being raised with the head 20, shown in dotted lines, being tilted or pivoted to simulate a child raising its arms and head to be picked up. The position of the head and arms shown in FIG. 2 is the normal position of these members of the doll effected by the normal bias provided by spring 78 to urge the head and arm pivoting member 68 in a counterclockwise direction as viewed in FIG. 2.

As will hereinafter be described, the operation of the doll is commenced by moving the arm 18, as viewed in FIG. 2, downwardly in the counterclockwise direction to thereby rotate gear member 56 of the arm coupling member 60 in a counterclockwise direction. This rotation of gear member 56 engaging sector 74 of member 68 causes member 68 to rotate in a clockwise direction against the force of bias spring 78 until the arm 18 and head 20 are in the dotted line position shown in FIG. 3. In this position the free end of switch arm 76 engages an abutment or shoulder 80 formed in a resilient metallic contact member 82 to retain switch arm 76, and consequently member 68, in the position shown in FIG. 3 against the force of bias spring 78.

Figure 4:
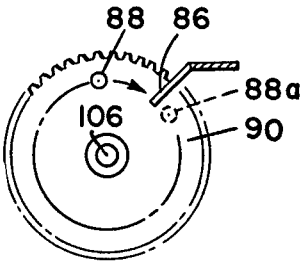
FIG. 4 is a view taken along line 4—4 of FIG. 3 illustrating the switch trip mechanism.

The contact member 82 is basically a general L-shaped switch arm having the long leg thereof suitably secured to a sidewall of the front half 34 of component housing 33 by means such as a rivet 84. The other leg of contact member 82 extends inwardly into the interior of component housing 33 with the shoulder 80 being intermediate the bent portion and the free end thereof. The free end of the short leg is provided with a transversely extending downwardly inclined portion 86 which, as can be seen in FIG. 4, is adapted to be engaged by a projection 88 extending transversely to the outer surface of a gear member 90 of the drive means to cause the portion 86 to be deflected downwardly to thereby permit shoulder 80 to be lowered to release switch arm 76 thus permitting member 68 to be rotated counterclockwise as viewed in FIG. 2 under the force of bias spring 78.

As shown in dottled lines in FIG. 3, the long arm of contact member 82 is normally biased outwardly out of contact with a stationary contact member 92 which is part of the electrical switch means to operate a motor 94. As the switch arm 76 engages the short leg of contact member 82, the long leg is pulled inwardly into contact with stationary contact 92 thereby completing an electrical circuit for motor 94. Stationary contact 92 is mounted generally in the plane of the wall to which the long leg of contact member 82 is secured by rivet 84. Under tension of spring 78 of interconnecting member 68, engagement of switch arm 76 against shoulder 80, latches the arms in the pivoted position and urges the long arm of contact 82 into electrical contact with stationary contact 92.

Referring again particularly to FIG. 1, the upper portion of the component housing 33 is configured to form a pair of spaced battery compartments 98 and 100, configured to receive a pair of "C" cells or the like. The battery compartments 98 and 100 are disposed on either side of the sector gear portion 70 of the head and arm pivoting member 68. Suitably provided in the back of the torso 10 is a battery compartment closure (not shown). Disposed generally centrally with respect to the component housing 33 a motor 94 is secured to the front half 34 of component housing 33 with a portion thereof extending within component housing 33, the motor 94 having the shaft thereof provided with a pinion gear 102 (see also FIG. 2). The gear 102 engages a first gear 104 which is disposed on an axis or shaft 106, the gear 104 having a pinion portion 108.

Disposed from front to rear within component housing 33 are first and second parallel shaft members 110 and 112 suitably secured within the housing 33 for receiving gear members and cam means rotatably thereon. The shafts 110 and 112 extend on a line from the front to rear of the torso 10 in the assembled condition. Received on shaft 110 from front to rear is a first gear member having a large diameter gear 114 with an integral small diameter pinion 116 extending rearwardly and an eccentrically positioned shaft portion 118 extending forwardly. Received next on shaft 110 rearwardly of this gear 114 is a second gear member having a large diameter gear 120 and a smaller diameter gear portion 122 integral therewith. Next in order is the above-described gear member 90 having the switch trip projection 88 extending therefrom, the gear member 90 having the rear surface thereof configured to form a cam trackway 124, the trackway 124 having a track formed of rearwardly extending parallel sidewalls (see also FIGS. 1 and 7).

Received on shaft 112 from front to rear is a first intermediate gear member having a large diameter gear portion 128 coacting with a pinion 116, the gear 128 having a reduced diameter pinion 130 in meshing engagement with large diameter gear 120. Disposed rearwardly of the first intermediate gear member is a second intermediate gear member having a large diameter gear portion 132 in meshing engagement with the reduced diameter gear 122 and a smaller diameter gear portion 134 coacting with the gear member 90 to rotate the same .

The relative gear diameters and number of teeth in each gear portion is preselected to provide one complete cycle of operation which corresponds to one complete revolution of the main cycle gear member which is gear member 90 which is provided with the switch trip projection 88 extending inwardly from one surface thereof to trip the switch means, and the cam trackway 124 extending rearwardly on the other surface thereof, this cam trackway 124 being adapted to re-orient the pivot axis of the legs 12 and 14 as will hereinafter be discussed to enable the doll to walk along a curved line.

Figure 5:
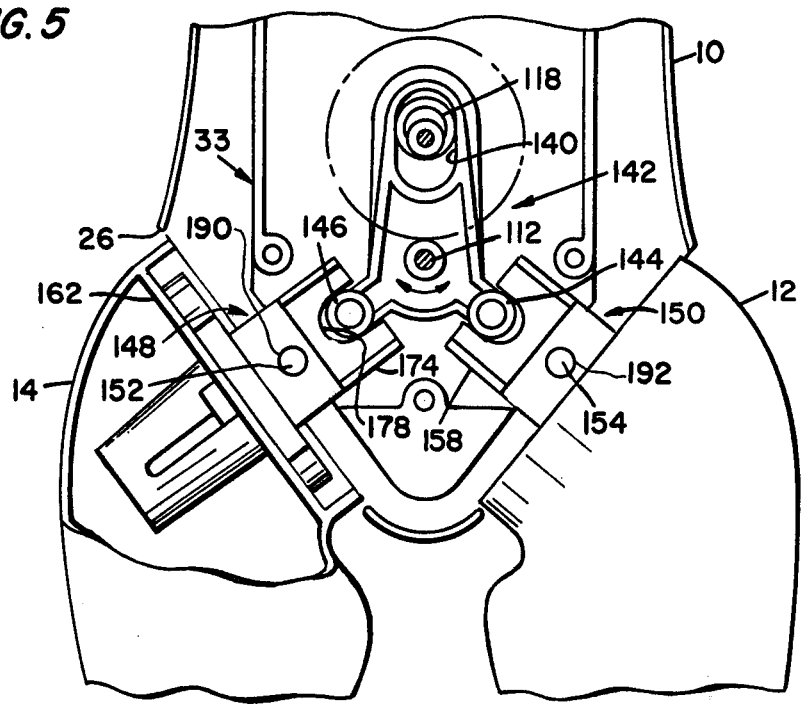
FIGS. 5 and 6 are front plan views of the lower portion of the torso with the front torso thereof removed to illustrate the side-to-side actuation of the walking mechanism.
Figure 6:
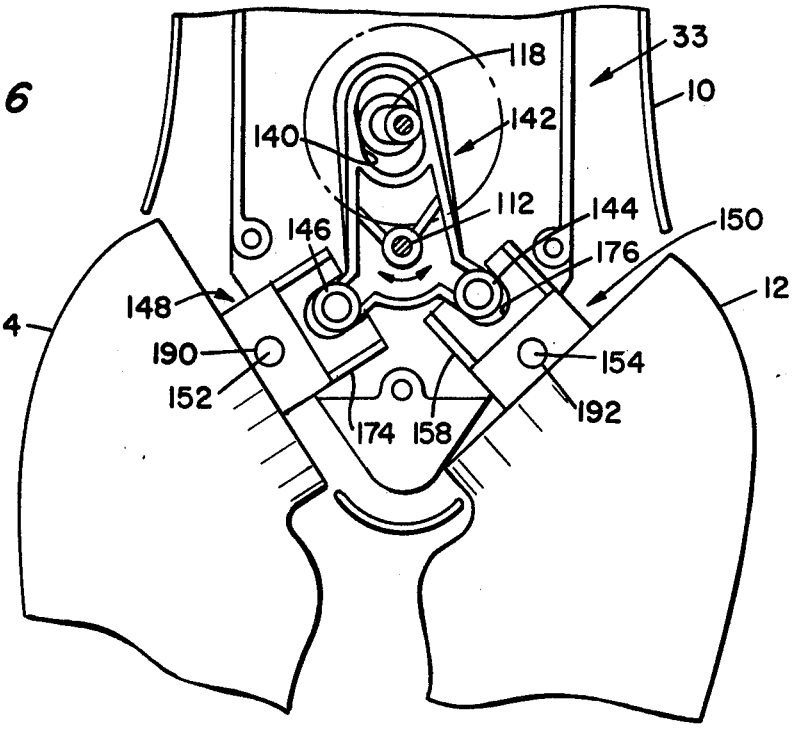

In the gear cluster of the drive means above-described the main power gear that provides the walking action is the first gear 118 which is direct coupled to the pinion 102 of motor 94 through gear 104 coacting with its pinion portion 116. Recall that the front surface of gear 118 is provided with an eccentric shaft portion 118, which as can be seen in FIGS. 5 and 6 is adapted to engage within an ovate slot 140 formed in the long arm of an inverted Y-shaped leg pivoting member generally designated 142. The member 142 has first and second divergent downwardly extending legs 144 and 146 having cylindrically formed free ends.

Each of the legs 12 and 14 is pivotally connected within component housing 33 by means of leg coupling members generally designated 148 and 150, respectively, which are pivoted about axes 152 and 154, respectively. The axes 152 and 154 are generally fore-to-aft with both legs 12 and 14 being pivoted simultaneously from side-to-side with respect to the torso 10. The leg coupling member 150 is provided with an enlarged flange 156, a first portion 158 extending inwardly from pivot axis 154 and a second oppositely directed cup-shaped portion 160 (see also FIG. 1). The leg 12 is provided with an integral web portion 162 adjacent the upper end thereof, the web 162 having an enlarged central aperture 164 through which cup-shaped portion 160 of leg coupling member 150 extends. Positioned internally within cup-shaped portion 160 is a compression spring 166 (see FIG. 1). The cup-shaped portion 160 is provided with a pair of aligned diametrically opposing longitudinally extending slots 168 and with the flange 156 abutting against web 162 of leg 12 the spring 166 is compressed during insertion of a bar member 170 through slots 168 to frictionally retain the web 162 of leg member 12 to the coupling member 150. As illustrated in FIG. 1 the web 162 has one or more prepositioned nubs 172 which engage mating detents formed in the adjacent coacting surface of flange 156 to permit rotation of leg 12 with respect to the coupling member 150. At least one nub 172 is positioned in a location corresponding to leg 12 being vertical with respect to the torso 10. The leg coupling member 148 is identically configured with each of the legs 12 and 14 being simultaneously pivotable in concerted fashion about the respective pivot axes 152 and 154. The view as shown in FIGS. 5 and 6 is a view looking in the same direction as the view of FIG. 1, that is from the rear of torso 10 toward the front, although the balance of the components have been removed for purposes of describing the operation of the walking mechanism.

Leg coupling member 148 has an inwardly extending section 174 configured essentially identical to portion 158 of leg coupling member 150. Essentially each of these portions is an inwardly extending bar member having a recess 176 in the free end of portion 158 and a recess 178 in the free end of portion 174. The recesses 176 and 178 have generally parallel side edges terminating in an arc having a diameter approximately the same as the diameter of the free ends 144 and 146, respectively of the leg pivoting member 142. With the legs 12 and 14 generally vertical as viewed in FIG. 5, at the approximate intersection of two lines, one line extending from pivot axis 154 through the center of free end 144 and the other line extending from the pivot axis 152 through the center of free end 146, the leg pivoting member 142 is pivoted about shaft 112. With eccentrically positioned shaft 118 traveling with the ovate slot 140 of leg pivoting member 142, the member 142 will pivot or rock through an arc about axis 112 as indicated by the double-ended arrow adjacent thereto thereby causing the free ends 144 and 146, respectively to ride within recesses 176 and 178, respectively, to thereby independently and concurrently pivot leg members 12 and 14 about their respective pivot axes 154 and 152.

If the axes 154 and 152 were captive within the doll at both ends the pivoting of the legs 12 and 14 would be strictly a side-to-side motion with no forward impetus of the doll.

To provide this forward impetus, the leg coupling members 148 and 150 are configured immediately adjacent the flange 156 thereof with generally box-shaped portions having a pair of aligned outwardly extending round shaft projections 190 and 192, respectively (only one of which is shown on each member in FIG. 7), the aligned shaft projections defining pivot axes 152 and 154, respectively, of legs 14 and 12, respectively.

As illustrated in FIG. 7 the shaft projection 190 (not shown) adjacent the front of leg coupling member 148 fits into a suitable aperture of a bearing projection 194 while the shaft projection 192 is fitted into a similarly configured second bearing projection 196, both bearing projections being on the inner surface of the front half 34 of component housing 33. The apertures of bearing projections 194 and 196 are circular in cross section but slightly larger than the coacting pivot projections 190 and 192 to permit a slightly loose fit. The opposite pivot projections 190 and 192 fit within rotatable bearing members 198 and 200, respectively which are captively rotatably retained within apertures 202 and 204, respectively formed in the rear half 36 of component housing 33. The bearing members 198 and 200 are identically configured with each being provided with a slotted recess 206 for receiving pivot projections 190 and 192 respectively. As illustrated in FIG. 1 in dotted lines on bearing member 198 the slot 206 is shown in two positions designated 206 and **206*a*, the slot position identified with numeral 206 being in an upright or vertical position, this being the normal alignment of slot 206 to cause the doll to walk in a straight line. The slot position designated 206*a* is the position of the slot when the bearing member 198 is rotated in the counterclockwise direction as indicated by the arrow adjacent thereto to effect a walking of the doll along a curved line as will hereinafter be discussed. It is to be emphasized that the bearing member 200 has an identically configured slot which is maintained in parallel relation with slot 206 at all times even as the two bearing members 198 and 200** are being rotated.

The connection of the leg coupling members 148 and 150 to the torso is by means of a fixed circular front pivot at bearing projections 194 and 196, respectively, with the rear pivots being accomplished by means of round shaft or pivot projections 190 and 192 fitting within vertically positioned slots 206 in bearing members 198 and 200 a certain amount of play or "wobble" exists on a vertical line with both rear pivots or slots being vertically aligned as shown in dotted lines designated 206 in FIG. 1. With a fixed front pivot and a wobbly rear pivot, as the center of gravity of the doll is shifted toward the ground engaging foot during the side-to-side motion as depicted in FIGS. 5 and 6, the following action results. By reference to FIG. 6 when the eccentric shaft projection 118 moves to the left of the longitudinal center line of the doll torso 10, leg 12 is pivoted clockwise due to the counterclockwise urging of the drum-shaped free end 144 of leg pivoting member 142 within recess 176 with corresponding clockwise rotation of leg 14 about its pivot axis 152. This results in the center of gravity of the doll being shifted to the right as viewed in FIG. 6 to place the weight of the doll on the leg 12 thereby slighly lifting leg 14. During this lifting action the rear pivot projection 190 of leg coupling member 148 drops within slot 206 (which is vertically aligned) providing an incremental forward movement of leg 14 along a straight line due to the vertical alignment of slot 206. Correspondingly as the weight is shifted to leg 14 leg 12 will be provided with forward impetus due to the slotted bearing recess within bearing member 200. By means of this construction the pivot axis of each leg is normally generally parallel to the ground or the surface on which the doll is walking. However, once the weight is shifted to one leg the pivot axis of the other leg is re-defined by means of the slot so that the rear portion of the pivot axis dips toward the surface to increment the so-lifted leg forwardly under the impetus of movement of the doll.

To enable the doll to walk along a curved line the outer cylindrical surfaces of bearing members 198 and 200 are provided with gear sector portions which matingly coact with gear teeth formed in the outer free arms 210 and 212, respectively, of an inverted generally Y-shaped actuating member generally designated 214 which is pivotally mounted at the approximate center thereof to shaft 112. The third arm of actuating member 214 is provided with a generally arcuate recess 216 which receives a disc-shaped free end 218 of a cam follower lever 220 which is pivotally secured at the other end thereof to shaft 106. The cam follower lever 220 (see FIG. 7) is provided with an inwardly extending cam follower pin 222 fitting within the cam trackway 124 of gear member 90. The cam follower pin 222 has a diameter slightly less than the distance between opposing parallel sidewalls forming cam trackway 124, and as best illustrated in FIG. 1 through an arc of approximately 285 to 295°. The cam trackway 124 is at its minimum diameter with respect to the center of gear 90 generally defining a circular path until a segment is reached designated **124*a* which provides an arcuate path of greater diameter through approximately 65 to 70° of an arc. During the traversal of the cam follower pin 222 through the cam trackway 124*a* the cam follower lever 220 is pivoted in a counterclockwise direction about its pivot axis 106 resulting in a pivoting of the actuating member 214 in a counterclockwise direction. This movement of actuating member 214 results in a corresponding clockwise rotation of bearing members 198 and 200 until slots 206** are displaced approximately 60° counterclockwise to the dotted line position designated 206*a* in FIG. 1. When this occurs the rear pivots of pivot axes 152 and 154 as defined by the slots **206*a* results in movement of the rear pivots along a line at an angle to vertical of approximately 60°. With the rear pivot slots thus re-defined, it being understood that both slots would still maintain the parallel alignment, the action which results with respect to the plane or surface on which the doll is walking is as follows. In viewing the feet of the doll at the moment the right leg 12, for example, engages the ground with the weight correspondingly shifted toward leg 12, as leg 14 is lifted out of engagement with the ground the pivot projection 190 would move under the force of gravity to the right of slot 206*a* thereby resulting in a turning action of the foot so that the toe of the foot would point outwardly to the left. As the weight is shifted to leg 14 the pivot projection 190 would move to the left of slot 206*a* while correspondingly leg 12 which is now out of engagement with the ground would have the toe thereof wobbled or pivoted toward the foot of leg 14. By repeating this action the realignment of slots 206 to the dotted line position designated by 206*a* effects the walking of the doll along a curved line so long as the cam follower pin 222 of cam follower lever 220 is engaging the cam trackway section 124*a* of gear member 90. As the gear member 90 continues its rotation the cam follower lever 220 is then re-directed so that the cam follower pin 222 thereof follows the main portion of cam trackway 124, this pivoting of cam follower lever 220 resulting in a realignment of the slots back to the dotted line position designated 206**, that is a vertical position.

The operation of the doll will now be discussed. In the normal position preparatory to operating the doll, the legs 12 and 14 are pivoted with respect to the leg coupling members 150 and 148, respectively, to provide a vertical alignment with respect to the upright torso 10, it being understood that the legs 12 and 14 are made of generally rigid plastic material as is the torso 10. The arms 16 and 18 initially are in the position depicted in FIG. 2 in dotted lines with the arm 18 extending somewhat upwardly with the head 20 (also shown in dotted lines) tilted slightly backwards to simulate an infant wanting to be picked up with its head and arms raised. In the position shown in FIG. 2 the switch arm 76 is out of engagement with the switch means which includes the movable contact member 82, the switch arm 76 being retained in its normal position under force of bias spring 78 coacting with the free end thereof. Also in this position, referring to FIG. 1 the gear member 90 is at a point where the cam follower pin 222 is located within the cam trackway 124 at a point approximately 180° from the midpoint of the larger radius cam trackway segment **124*a*. Correspondingly, with reference to FIG. 4 the switch trip projection 88 on the opposite surface of gear member 90 is positioned with respect to portion 86 of the movable contact member 82 generally at the position designated in dotted lines 88*a*, that is just beyond the trip position of the switch arm formed by the movable contact member 82. Correspondingly, referring to FIG. 2 the movable contact member 82 will be spaced from the stationary contact member 92 thereby creating an open switch. It is to be understood at this point that the movable contact member 82 and stationary contact 92 are suitably electrically wired in conventional fashion to motor 94 for the batteries insertable within battery compartments 98 and 100**.

To operate the doll and energize the motor 94 the arms 16 and 18 as viewed in FIG. 2 are lowered to the dotted line position illustrated in FIG. 3 thereby pivoting head and arm pivoting member 68 in a clockwise direction until switch arm 76 thereof is detented in abutting relation with shoulder 80 formed in the movable contact 82. This action results in inward movement of the long leg of contact member 82 which electrically engages the stationary contact member 92. Although the contact member 92 is referred to as stationary it is to be understood that is can have a slight amount of resilience in the inward direction but in any event should be configured to provide an electrical contact upon retention by the movable contact member 82 of the switch arm 76 within shoulder 80 to close the switch in the direction indicated by the arrow adjacent thereto in FIG. 3.

At this point an electrical circuit is completed to the motor 94 thereby energizing the drive means and rotating the gear members due to the coupling between the pinion 102 of the motor 94 with the first gear 104 of the gear train. The gear ratios are so selected that the control gear 90 effects one complete revolution per cycle while the main power gear 114 having eccentric shaft portion 118 extending from the front surface thereof rotates at a speed sufficient to enable the doll, during this single revolution of control gear 90, to walk out a distance of approximately 3 feet in a straight line then along a curve then back to the approximate starting point.

As the walking action commences the slots 206 (see FIG. 1) in bearing members 198 and 200 are vertically aligned with respect to the surface on which the doll is walking and parallel to each other thus resulting in a forward kicking movement of the leg out of engagement with the ground as above described, resulting in a walking in a straight line of the doll. As the control gear 90 continues to rotate cam follower pin 222 continues to follow the rotating cam trackway 124 until the cam trackway segment **124*a* is reached, this corresponding to a rotation of control gear 90 through an angle equal to 180° minus one-half the angle of the arcuate cam trackway segment 124*a*. At this point the cam follower lever 220 is pivoted counterclockwise as viewed in FIG. 1 thereby pivoting actuating member 214 with an intended rotation of bearing members 198 and 200 in the counterclockwise direction until the still parallel slots are realigned approximately 60° to the dotted line position designated 206*a*. For the time duration corresponding to the distance of travel of cam follower pin within cam trackway segment 124*a***, the feet of the doll as viewed in the plane of the surface upon which the doll is walking, are alternately re-directed with the toes thereof pointing to the left or counterclockwise to enable the doll to walk along a curved line.

With proper selection of the size of the cam trackway 124 and the angle of the cam trackway segment **124*a*, at the terminal end of travel of the cam follower pin 222 within the cam trackway segment 124*a* the doll will be facing in the direction from which it originally came, that is back toward the child. As the cam follower pin 222 is guided back into the main portion of the cam trackway 124 the cam follower lever 220 is then pivoted clockwise thereby resulting in rotation of bearing members 198 and 200 clockwise until the slots for the rear pivots of the axes 152 and 154 are again aligned in a vertical direction to enable the doll to walk along a straight line. This action will commence until such time as the relative position of the cam follower pin 222 with respect to the cam trackway 124 is at its original position, that is with the cam follower pin 222 approximately 180° from the mid-point of cam trackway segment 124*a*. Just prior to the final rotation to this position, as viewed in FIG. 4 the trip switch projection 88 of control gear 90 engages the inclined ramp portion 86 of the free end of the short leg of movable contact 82, thus bending the free end of the short leg downwardly a distance sufficient for shoulder 80 to be depressed below the free end of switch arm 76 permitting it to be rotated under force of bias spring 78 from the position shown in FIG. 3 to that shown in FIG. 2. This last action correspondingly rotates the arms 16 and 18 upwardly as well as pivoting the head 20 to the position indicated in dotted lines in FIG. 2. Simultaneously with the release of switch arm 76 the free end of movable contact 82, due to its resilience, is flexed upwardly to the dotted line position shown in FIG. 3 thereby spacing contact 82 from the stationary contact 92 to "open" the switch thereby de-energizing the motor 94**.

Although the cam trackway 124 has been illustrated and described as being able to control the drive means and the walking mechanism to permit the doll to walk out a short distance in a straight line, then commence movement along a curve, and then return along a straight line generally parallel to the original line, it is to be understood that the cam trackway 124 can be suitably configured and the bearing members 198 and 200 suitably rotated to enable the doll to walk along other irregular paths.

Similarly although the switch trip projection is shown as being incorporated on the opposing surface of the control gear 90, the switch trip mechanism in conjunction with the switch means shown can be incorporated on a separate gear member with a corresponding speed ratio between the rotation of the member containing the cam trackway and that containing the switch trip means to vary the distance of travel of the doll if so desired. Similarly the head and arm pivoting interconnection can take different forms such as linkages or a ball and socket arrangement.

In summary, the mechanism herein shown and described with the pivot axes 152 and 154 being disposed on a generally fore-to-aft axis, the side-to-side simultaneous pivoting thereof in conjunction with the slotted bearing members 198 and 200 enable a doll to walk along a path determined by the position of the slots 206 with respect to a vertical line. The legs are pivotable with respect to the torso 10 in a side-to-side action with the forward impetus of each leg being directed with respect to a straight line in a direction determined by the angular positions of the slot, which effectively alter the movement of the legs with respect to the torso. The cam trackway 124 defines a cycle of operation in conjunction with the switch release projection 88 on the rear surface of the common gear member 90 with the cam trackway 124 being configured to enable the doll to walk out a short distance on a straight line then along a curved pathway through approximately one hundred and eighty degrees, from there to continue along a straight line back to its approximate starting point wherein the arms and head are pivoted in an upward direction to complete the cycle and de-energize the motor.

While there has been shown and described a preferred embodiment it is to be understood that various other adaptations and modifications may be made within the spirit and scope of the invention.

What is claimed is:

1. In a doll, the combination comprising:

a generally hollow torso;

a pair of depending substantially rigid legs, each of said legs being coupled to said torso for pivotal movement about shafts, each of said shafts being on a generally fore-to-aft axis;

drive means within said torso;

means within said torso coupling said drive means to both said legs to pivot both of said legs simultaneously side-to-side in the same direction relative to said torso about said shafts;

slotted bearing members operatively connecting the rear of each shaft to said torso, the slots of both said bearing members being arranged in parallel relation with each other in a normally vertical direction to enable each of said legs to have forward impetus to enable the doll to walk in a straight line forward direction; and means coupled to said drive means and to at least one of said slotted bearing members to rotate said bearing member through an angle to redirect the impetus of such leg at an angle to the forward direction to enable the doll to walk along a curved line.

2. The combination according to claim 1 wherein said means coupling said drive means and at least one of said bearing member includes rotatable cam means having a cam surface defining a cycle of operation.

3. The combination according to claim 2 wherein both of said bearing members are rotatable and operatively coupled for simultaneous rotation in response to rotation of said cam surface.

4. The combination according to claim 3 wherein said cam means is configured to align the slots of said bearing members for a predetermined portion of the cycle in a vertical direction to enable the doll to walk a distance in a straight line, then to simultaneously rotate said slots through an angle to enable the doll to walk along a curve of approximately one hundred eighty degrees, then to rotate said slots to enable the doll to walk in a straight line back to its approximate starting position.

5. The combination according to claim 4 wherein said doll further includes a pair of arms pivotally connected to said torso and an interconnecting member mounted within said torso and connected to both said arms to enable simultaneous pivoting thereof.

6. The combination according to claim 5 wherein said drive means includes an electric motor and a swtich having a movable contact and a stationary contact, said movable contact having a portion adapted for releasable engagement by said interconnecting member upon pivoting of said arms, said movable contact and said stationary contact being so-positioned that engagement by said interconnecting member actuates said switch means.

7. The combination according to claim 6 further including release means operatively connected to said drive means to release said movable contact out of engagement with said interconnecting member to deactivate said switch.

8. The combination according to claim 7 wherein said interconnecting member is spring-biased within said torso in a first direction and said arms are pivoted against the force of its bias to enable said interconnecting member to latch into engagement with said movable contact.

9. The combination according to claim 8 wherein said cam surface is on one surface of a rotatable member and said release means is a projection on the other surface thereof for engaging said movable contact to release said interconnecting means on completion of said cycle of operation.

10. In a doll, the combination comprising:

a generally hollow torso;

a pair of depending substantially rigid legs secured to said torso adjacent the lower end thereof, each of said legs being pivoted for movement about a shaft aligned on a generally fore-to-aft axis, the shaft of one leg being generally parallel to the shaft of the other leg, each shaft being defined by a forward pivot projection and an aligned rearward projection, each of the front pivot projections being connected to said torso in a generally circular bearing aperture;

a pair of pivotal bearing members secured within said torso, each of said bearing members having a slotted aperture receiving said rear pivot projections;

means within said torso operatively coupled to both of said bearing members for maintaining said slots within said bearing members in generally parallel relation in a generally upright position whereby to enable each of said legs to be moved forward under the force of gravity as the respective leg is lifted; and means driven by said drive means and coupled to said means operatively coupled to both said bearing members for pivoting said bearing members through an angle to re-direct the rear pivot line of said legs to enable said doll to walk along a curved line.

* * * * *